US010101138B2

(12) United States Patent
Kempas

(10) Patent No.: US 10,101,138 B2
(45) Date of Patent: Oct. 16, 2018

(54) SYSTEM OF MISSILE CONTROL SURFACES AND METHOD OF ASSEMBLING THE SYSTEM

(71) Applicant: DIEHL DEFENCE GMBH & CO. KG, Ueberlingen (DE)

(72) Inventor: Hagen Kempas, Ueberlingen (DE)

(73) Assignee: Diehl Defence GmbH & Co. KG, Ueberlingen (DE)

( * ) Notice: Subject to any disclaimer, the term of this patent is extended or adjusted under 35 U.S.C. 154(b) by 407 days.

(21) Appl. No.: 15/131,228

(22) Filed: Apr. 18, 2016

(65) Prior Publication Data

US 2017/0343327 A1 Nov. 30, 2017

(30) Foreign Application Priority Data

Apr. 22, 2015 (DE) ..... 10 2015 005 135

(51) Int. Cl.
*F42B 15/01* (2006.01)
*F42B 10/64* (2006.01)

(52) U.S. Cl.
CPC ..... *F42B 10/64* (2013.01)

(58) Field of Classification Search
CPC ..... F42B 10/64; F42B 10/60; F42B 10/62
See application file for complete search history.

(56) References Cited

U.S. PATENT DOCUMENTS 2,916,922 A 12/1959 Sorensen
4,170,146 A * 10/1979 Owens ..... F16H 19/0622 74/89.2
4,366,722 A * 1/1983 Hasler ..... F16H 19/0622 360/267
4,419,707 A * 12/1983 Woodier ..... F16H 19/0622 360/267
5,040,745 A * 8/1991 Oswald ..... B64C 13/34 244/3.21
5,249,761 A 10/1993 Schroppel
5,293,811 A 3/1994 DeLair et al.
5,904,319 A 5/1999 Hetzer
7,121,353 B2 10/2006 Setzer
9,194,466 B2 11/2015 Miller et al.
(Continued)

FOREIGN PATENT DOCUMENTS

DE 19624187 C1 1/1998
DE 19635847 C2 7/1998
DE 4135557 C2 5/1999
(Continued)

*Primary Examiner* — Philip J Bonzell
(74) *Attorney, Agent, or Firm* — Laurence A. Greenberg; Werner H. Stemer; Ralph E. Locher

(57) ABSTRACT

A system of missile control surfaces includes a control surface housing, a control surface shaft which is rotatably mounted in the control surface housing, a control surface secured on the control surface shaft, a control surface drive and a coupling unit. The coupling unit couples the control surface drive to the control surface shaft in such a way that a movement of the control surface drive produces a rotation of the control surface shaft. To enable high forces to be applied reliably to a guided missile control surface, it is proposed that the coupling unit has at least one flexible tension element, which is secured on the control surface drive and is rolled up onto the control surface shaft to a certain extent.

13 Claims, 2 Drawing Sheets

(56) References Cited

U.S. PATENT DOCUMENTS

| | | | |
|---|---|---|---|
| 2006/0097212 | A1 | 5/2006 | Kindersley |
| 2011/0073705 | A1 | 3/2011 | Huguenin et al. |

FOREIGN PATENT DOCUMENTS

| | | | |
|---|---|---|---|
| DE | 10346163 | A1 | 5/2005 |
| EP | 0529796 | A1 | 3/1993 |
| EP | 2568189 | A1 | 3/2013 |
| WO | 2013102188 | A1 | 7/2013 |

* cited by examiner

SYSTEM OF MISSILE CONTROL SURFACES AND METHOD OF ASSEMBLING THE SYSTEM

CROSS-REFERENCE TO RELATED APPLICATION

This application claims the priority, under 35 U.S.C. § 119, of German application DE 10 2015 005 135.0, filed Apr. 22, 2015; the prior application is herewith incorporated by reference in its entirety.

BACKGROUND OF THE INVENTION

Field of the Invention

The invention relates to a system of missile control surfaces having a control surface housing, a control surface shaft, which is rotatably mounted in the control surface housing, a control surface secured on the control surface shaft, a control surface drive and a coupling unit, which couples the control surface drive to the control surface shaft in such a way that a movement of the control surface drive produces a rotation of the control surface shaft.

At the nose or tail, guided missiles have control surfaces, by which their flight is guided and they thus approach a predetermined target. For movement of a missile control surface, guided missiles are fitted with a control surface drive, which introduces forces for deflection of the control surface into the control surface via a coupling unit. Owing to the high flight velocities of a guided missile, very high forces act on a control surface of the guided missile, especially during sharp steering movements. It must therefore be possible to move a control surface reliably and precisely against high opposing forces.

SUMMARY OF THE INVENTION

It is an object of the present invention to indicate a system of missile control surfaces by which high forces can be applied reliably to a guided missile control surface.

The object is achieved by a system of missile control surfaces of the type stated at the outset in which, according to the invention, the coupling unit has at least one flexible tension element, which is secured on the control surface drive and is rolled up onto the control surface shaft to a certain extent. It is possible for a high force to be applied reliably to the control surface by the control surface drive via the coupling unit with little backlash and little hysteresis movement. By virtue of the rolling up, simple conversion of, for example, a translational movement into a rotational movement can be produced in combination with a connection between the coupling unit and the control surface shaft which is subject at least to little backlash.

The rotational movement of the control surface shaft can be achieved in both directions by a single tension element, which is guided at least substantially completely around the control surface shaft and secured at both its free ends on the control surface drive. The provision of two tension elements, each intended for a single direction of tension, is likewise possible. It is expedient if these elements are each rolled up partially onto the control surface shaft in mutually opposite directions, enabling each of the two tension elements to exert the tension on the control surface shaft in one direction. When the control surface shaft is rotated, one tension element is correspondingly rolled up on the control surface shaft and the other is unrolled from the control surface shaft.

If there is only a single tension element, one end of the tension element is rolled up onto the control surface shaft and the other end is unrolled during rotation of the control surface shaft.

The tension element can be a strand, a band, a flexible rack or a toothed belt or the like. It is expedient if the tension element is manufactured at least predominantly from steel, in particular as a steel band, allowing high forces to be transferred between the control surface drive and the control surface shaft.

In an advantageous embodiment of the invention, the control surface drive is a translational drive having a piston unit, and the tension element is secured on the piston unit. The piston unit can be retracted and extended again into and out of a drive housing in a translational movement, with the result that the tension element can also accompany the translational movement of this retraction and extension, at least with one end. By means of a translational drive, a movement for deflection of the control surface shaft can be produced in a simple and very precise manner. It is expedient if the translational drive is a spindle drive, wherein it is expedient if the piston unit is rotation-free during its translational movement. The tension element can be screwed to the piston unit, for example, or can be secured by positive engagement, material engagement or integrally on the piston unit in some other way.

It is expedient if the tension element is embodied integrally with the piston unit. It is thereby possible to achieve securing of the tension element on the piston unit in a manner which is particularly precise in terms of position. Moreover, assembly can be kept simple. For example, the tension element can be detached from the body of the piston unit on one side using the wire erosion process, while the other end of the tension element remains connected integrally to the piston unit.

A particularly simple design of the coupling unit can be achieved if the coupling unit has two interengaging piston pieces, which are expediently mounted so as to be movable relative to one another. One tension element can be secured on each of the two piston pieces, or, in the case of just one tension element extending around the control surface shaft, each end of the tension element can be secured on one of said piston pieces.

It is furthermore advantageous if the coupling unit has a bracing element, by which the two piston units can be braced relative to one another, e.g. by being pushed apart. The bracing element can be a threaded element which is screwed into one of the piston pieces and which pushes the other piston piece out of the first piston piece by being screwed in.

Particularly in the case of rapid steering maneuvers of the guided missile, high forces can act on the control surface and hence also stress the tension element. In order to prevent the tension element being torn off an element of the control surface drive, it is advantageous if the tension element is thicker in the region in which it is secured than in the winding region, in particular radially in relation to the control surface shaft. By the thickening, it is possible to counteract a break at a fastening point, e.g. one end of a notch between the tension element and the control surface drive element embodied integrally therewith.

In particular, it is advantageous if the tension element is secured on an element of the control surface drive, and a winding region of the tension element is separated from the element of the control surface drive by a gap, and, in the region of the gap, the tension element is embodied so as to thicken radially towards the end of the gap, in particular towards the control surface shaft. Thus, it is expedient if the tension element becomes thicker, in particular continuously thicker from the winding region to the end of the gap, thereby making it possible to counteract a break at the end of the gap in an effective manner.

Space for the control surface mechanism in the guided missile may be severely limited, and therefore a compact design is advantageous. In this respect, it is advantageous if the control surface drive is a translational drive having a piston unit and a piston housing, and the tension element together with the piston unit extends into the piston housing. When the piston unit moves into the piston housing, one end of the tension element moves within the piston housing, and one region of the tension element moves into the piston housing. This makes it possible to arrange the winding region very close to and, in particular, partially in the piston housing.

Moreover, the invention relates to a system of missile control surfaces of the type stated at the outset which can be kept particularly compact by virtue of the fact that, according to the invention, the control surface shaft is held on the control surface housing by an outer radial bearing and is held at least indirectly on the control surface housing by an inner radial bearing. It is expedient if the inner radial bearing is held on an inner housing, e.g. an engine housing or engine tube. Needle bearings are particularly suitable as bearings since they can be of particularly small construction radially and withstand high loads.

It is furthermore conducive to the compactness of the system of missile control surfaces if the inner radial bearing is arranged at the axial level of the tension element. Here, the axial level refers to the axial direction of the control surface shaft. While the control surface shaft is held from the inside by the inner radial bearing, the tension element can reach at least partially around the control surface shaft from the outside.

Simple assembly can be made possible if the control surface shaft is mounted on a holding unit on its side facing away from the control surface and is held axially by positive engagement on the holding unit. The positive engagement can be achieved by twisting the control surface shaft on the holding unit, for example. It is expedient if the control surface shaft and the holding unit form an axial sliding bearing. Owing to the low axial forces, this can be kept free from bodies of revolution and hence can remain of simple configuration. By way of example, the holding unit can be an engine housing or engine tube.

Moreover, it is advantageous if the control surface shaft is held radially on the holding unit by an inner radial bearing. Like an axial bearing assembly, a radial bearing assembly can also be achieved in a compact way.

The invention is furthermore directed to a method for assembling a system of missile control surfaces, in which a control surface drive is secured on a control surface housing. Particularly simple assembly can be achieved if a control surface shaft is inserted into the control surface housing from the outside and a flexible tension element of a coupling unit is secured on the control surface shaft. It is expedient if the tension element is secured on the control surface drive. It is advantageous if the tension element is rolled up on the control surface shaft by rotating the latter. Part of the tension element can rest externally on the control surface shaft, while another part is secured on the control surface drive. The sequence of method steps is optional and can expediently be matched to the design.

Particularly simple axial retention of the control surface shaft can be achieved if it is secured axially by positive engagement on an inner axial bearing by the rotation. In particular, the control surface shaft is pushed onto a holding unit forming half of the inner axial bearing as it is inserted into the control surface housing.

The above description of advantageous embodiments of the invention contains numerous features which are grouped together in a number of dependent claims. However, it may also be expedient for these features to be considered individually and grouped into other expedient combinations, especially where claims have dependency references, and therefore a single feature of a dependent claim can be combined with a single feature, several features or all the features of another dependent claim. Moreover, these features can each be combined individually and in any suitable combination both with the method according to the invention and with the device according to the invention in accordance with the independent claims. Thus, method features may also be considered in substantive terms as characteristics of the corresponding device unit, and functional device features may also be considered as corresponding method features.

The above-described characteristics, features and advantages of this invention and the way in which these are achieved will be clearer and more clearly understandable in conjunction with the following description of the illustrative embodiments, which are explained in detail in conjunction with the drawings. The illustrative embodiments are used to explain the invention and do not restrict the invention to the combination of features given therein, including functional features. Moreover, features of each illustrative embodiment which are suitable for this purpose can also be considered explicitly in isolation, removed from one illustrative embodiment, introduced into another illustrative embodiment to supplement the latter and/or combined with any one of the claims.

Other features which are considered as characteristic for the invention are set forth in the appended claims.

Although the invention is illustrated and described herein as embodied in a system of missile control surfaces, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
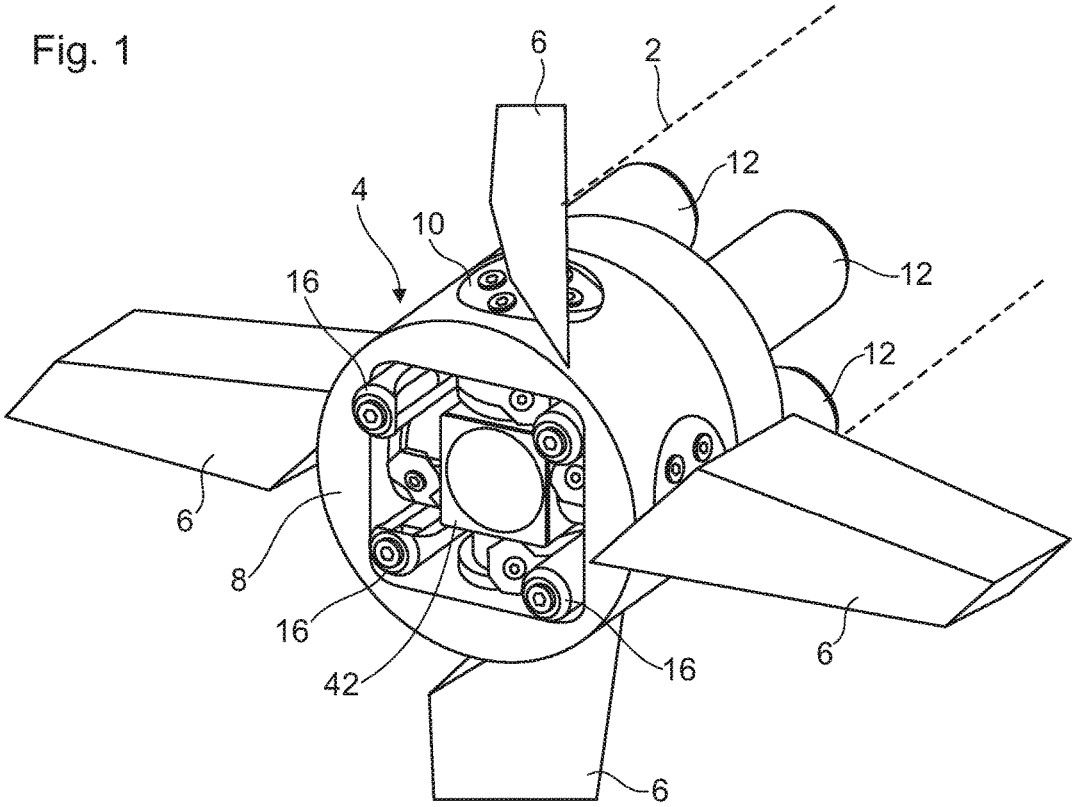
FIG. 1 is a diagrammatic, perspective view of a rear portion of a guided missile having a system of missile control surfaces which contains four axially rotatable control surfaces in a case of a control surface housing opening at a rear, according to the invention.

Referring now to the figures of the drawings in detail and first, particularly to FIG. 1 thereof, there is shown a rear part of a guided missile 2 having a system 4 of missile control surfaces, which has four control surfaces 6, each arranged offset by 90° relative to one another, on a control surface housing 8. The control surfaces 6 are each secured on a control surface shaft 10, which is inserted into the control surface housing 8 in the axial direction of its control surface 6. The control surface shafts 10 are rotatably mounted within the control surface housing 8 in the axial direction of the control surfaces 6, with the result that the control surfaces 6 are also rotatable, as indicated by the example of the control surface 6 shown at the top in FIG. 1.

For each control surface 6, a control surface drive 12 is arranged at least partially within the control surface housing 8. The control surface drives 12 are spindle drives having a motor and a spindle, which is rotated by the motor. A control unit controls the motor in the forward or reverse direction of motion thereof, and the spindle is therefore rotated in one or the other direction. A coupling unit 14 with in each case two piston units 16, 18, which are illustrated so as to be easily visible in FIG. 3, is screwed onto the spindle.

Figure 4:
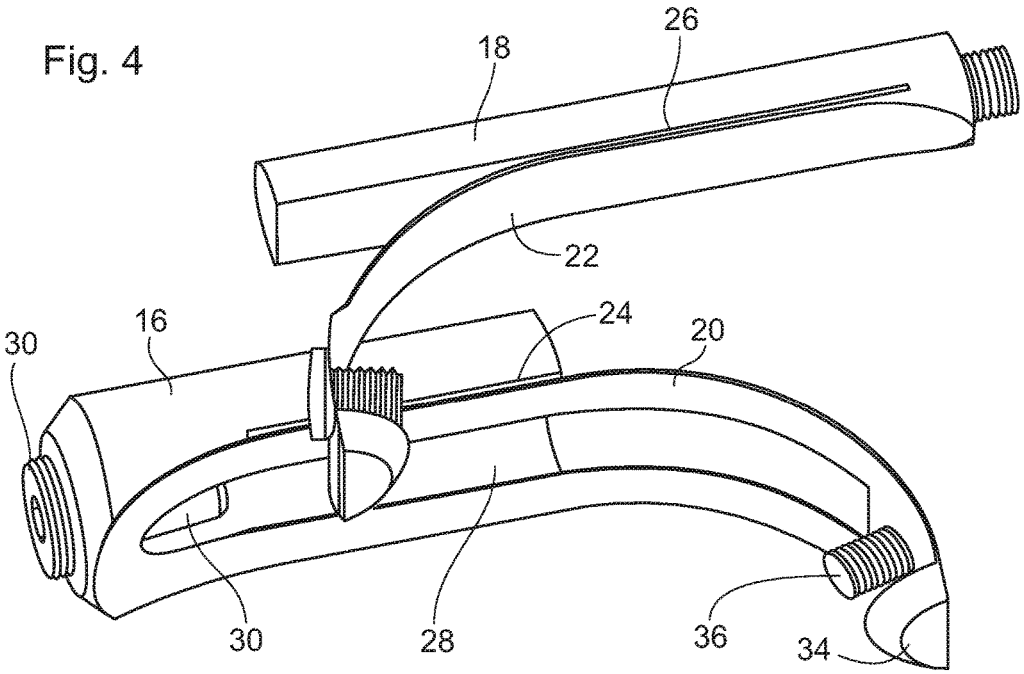
FIG. 4 is a perspective view of the two piston units in the disassembled state with the two tension elements.

As can be seen from FIG. 4, the two piston units 16, 18, which are manufactured from stainless steel, are each provided with a tension element 20, 22, which is in each case embodied integrally with the piston unit 16, 18 thereof. The tension elements 20, 22 are each cut out of their piston unit 16, 18 by a cut which produces a gap 24 and 26, respectively, the two tension elements 20, 22 thus each being shaped as steel bands. The cuts have been introduced into the corresponding piston unit 16, 18 by wire erosion.

Figure 3:
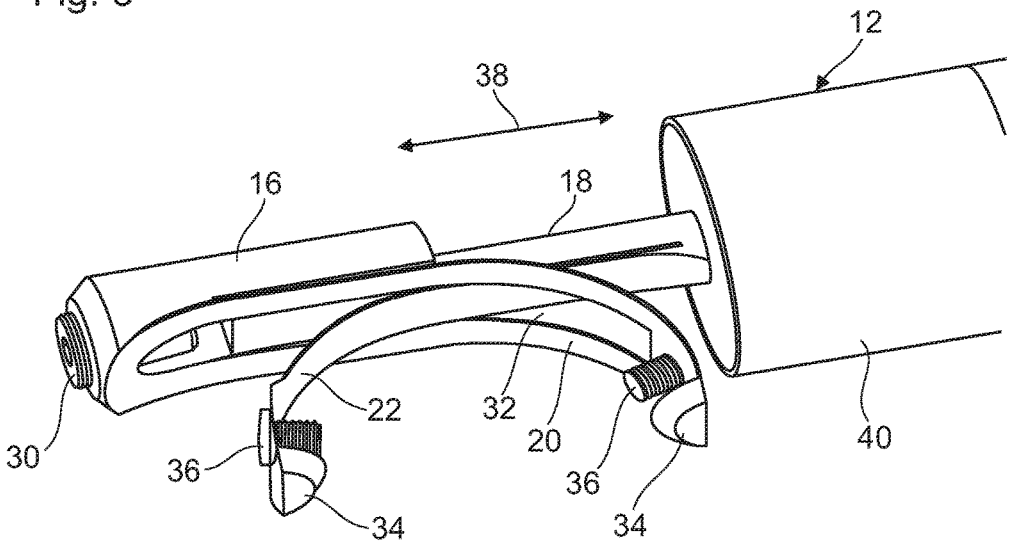
FIG. 3 is a perspective view of the control surface drive from FIG. 2 with two piston units, on each of which a tension element is secured.

As can be seen from FIGS. 3 and 4, the piston unit 16 has an inner opening 28, into which piston unit 18 is inserted. In this arrangement, a bracing element 30 screwed into piston unit 16 serves as a stop for the piston unit 18 inserted. Tension element 22 is passed through a slot 32 in tension element 20.

Figure 2:
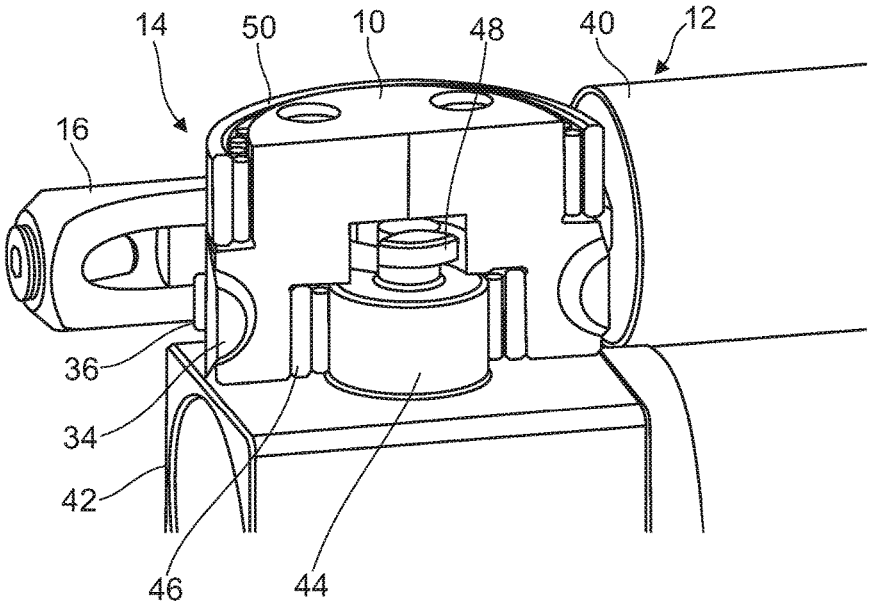
FIG. 2 is a perspective view of a control surface shaft mounted on a holding unit of an engine tube with the control surface drive situated behind the control surface shaft.

The two tension elements 20, 22 are each provided at the end thereof with a holder formation 34 and a holding device 36, by which they are each anchored in the control surface shaft 10, as can be seen from FIG. 2. The holder formations 34 each engage in a depression in the control surface shaft 10, and the holding device 36, in this illustrative embodiment screws, hold the tension elements 20, 22 and the holder formation 34 in place. In the assembled state, the tension elements 20, 22 are placed around the outside of the control surface shaft 10 and rolled onto the shaft to a certain extent, as can be seen from a combination of the illustrations in FIGS. 2 and 3.

To secure the tension elements 20, 22 tightly on the control surface shaft 10, use is made of the bracing element 30, the screwing of which into piston unit 16 pushes piston unit 18 out of piston unit 16 to a certain extent. The tension element 22 is thereby pulled through the slot 32 in tension element 20 and braced firmly against the control surface shaft 10.

During operation, the control surface drive 12 is actuated by the drive motor, causing the spindle to rotate and the piston unit 18 screwed onto the spindle to perform a translational movement 38. As the piston unit 18 is extended from the piston housing 40, tension element 20 exerts a tension on the control surface shaft 10, which is arranged so as to be immobile relative to the piston housing 40 in the direction of translation. As a result, the control surface shaft 10 is rotated about its axis. As the piston unit 18 is retracted into the piston housing 40, the tension element 22 similarly exerts a tension on the control surface shaft 10 and rotates it in the other direction. During this process, tension element 22 moves into the piston housing to a certain extent, as can be seen from the illustration in FIG. 3. In the illustration in FIG. 3, the piston unit 18 has been extended to the maximum extent out of the piston housing 40. As it is retracted, one end of the tension element 22 is also retracted into the piston housing 40.

At the point where the tension elements 20, 22 are secured on the piston unit 16, 18 thereof, in particular at the end of the respective gap 24, 26, particularly high forces occur, which could cause a tension element 20, 22 to tear off the corresponding piston unit 16, 18. In order to avoid this, the tension elements 20, 22 are embodied so as to be thickened towards their end in a radial direction towards the control surface shaft 10, as compared to the winding region of the corresponding tension element 20, 22. Consequently, the radial thickness of the tension element 20, 22 increases in a direction towards the end of the tension element 20, 22 which is secured on the piston unit 16, 18. As a result, the tension element 20, 22 is at least twice as thick at the location of the end of the gap as in the winding region, with the result that the forces arising at the end of the gap can be well absorbed by the thickness of the tension element 20, 22.

To assemble the system 4 of missile control surfaces, an engine tube 42, through which the exhaust jet of an engine of the guided missile 2 is passed during the operation of the guided missile 2, is secured on the control surface housing 8. For each control surface shaft, the engine tube 42 has a holding unit 44, on which an inner radial bearing 46 is mounted or has already been mounted. The control surface shaft 10 is then pushed onto the holding unit 44 through the control surface housing 8, with the result that the control surface shaft 10 fits over the inner radial bearing 46. The holding unit 44 has an outward-pointing formation 48 in the form of a bayonet catch, into which a corresponding mating part of the control surface shaft 10 engages. Rotating the control surface shaft 10 through 90° causes the mating part to engage behind the bayonet piece 48 of the holding unit 44, thus forming positive engagement in the axial direction of the control surface shaft 10 and ensuring that the control surface shaft 10 is secured on the holding unit 44 in the axial direction. With the corresponding mating part of the control surface shaft 10, the bayonet piece 48 forms an axial sliding bearing, by which the control surface shaft 10 is held on the engine tube 42 in the axial direction. The control surface shaft 10 is held in the radial direction in the control surface housing 8 by an outer radial bearing 50, which has already been connected to the control surface shaft 10 before assembly.

Both the inner radial bearing 46 and the outer radial bearing 50 are embodied by needle bearings. The use of this very advantageous and also load-bearing rolling bearing is possible since the coupling of the control surface shaft 10 to the control surface drive 12 allows very wide dimensional tolerances and does not introduce any axial forces into the control surface shaft 10. The required axial guidance of the control surface shaft 10 is achieved by the sliding bearing surfaces. The use of a sliding bearing is possible without problems here since only relatively low axial forces occur during the use of the system 4 of control surfaces.

Piston unit 16 is then introduced with its tension element 20 into the control surface housing 8 from the rear towards the front, and the control surface shaft 10 is twisted into a position such that tension element 20 can be screwed to the control surface shaft 10 by its holding device 36, which is embodied as a screw. This can be accomplished by means of an appropriate tool through the rear opening of the control surface housing 8, the opening being illustrated in FIG. 1.

The control surface shaft is then rotated through about 180°, with the result that piston unit 16 is pulled into the control surface housing 8 to some extent. The control surface drive 12 with the preassembled piston unit 18 can then be pushed into the control surface housing 8 from the front, and tension element 22 is threaded through the slot 32 in tension element 20. With the aid of the screw 36, tension element 22 is screwed to the control surface shaft 10 at the appropriate point on the latter, as can be seen from FIG. 2. The bracing element 30 is then screwed into piston unit 16, and the two tension elements 20, 22 are braced firmly against the control surface shaft 10.

Owing to the bracing of the steel bands, these are jointly under prestress so as to achieve backlash-free conversion of the translational movement into a rotational movement. During movement of the control surface shaft 10, the cylindrical region of the control surface shaft rolls in the immediate vicinity of the two piston elements 16, 18, as seen relative to the spindle. During this process, one of the tension elements 20, 22 is unrolled from the cylindrical surface, and the other tension element 22, 20 is correspondingly rolled up. During this process, there are no relative movements at points of contact between two bodies, and there is therefore also no friction. The material friction produced in the steel bands by the alternating bending is so small that it is negligible.

The axial positive engagement between the control surface shaft 10 and the holding unit 44 has been established by rotating the control surface shaft 10 into the position in which tension element 22 can be screwed to the control surface shaft 10. This positive engagement is maintained within the entire operating movement range of the control surface shaft 10, thus ensuring that the control surface 6 subsequently screwed onto the control surface shaft 10 remains firmly connected to the control surface housing 8.

During the operation of the guided missile 2, this flies towards a target and is guided towards the target by its seeker head in conjunction with its control unit. The control unit also controls the control surface drives 12 and hence a control surface movement of the control surfaces 6. By means of the coupling unit 14 with its two tension elements 20, 22, the translational movement of the control surface drive 12 or of the two piston units 16, 18 is converted into a rotational movement of the control surface shaft 10 and hence of the corresponding control surface 6.

This translational movement is converted from the tangential direction of the spindle of the control surface drive 12 into a circumferential direction of the control surface shaft 10 by means of the coupling on the circumference of a cylindrical surface of the control surface shaft 10. The translational movement becomes a rotary movement.

The following is a summary list of reference numerals and the corresponding structure used in the above description of the invention:

2 guided missile
4 system of missile control surfaces
6 control surface
8 control surface housing
10 control surface shaft
12 control surface drive
14 coupling unit
16 piston unit
18 piston unit
20 tension element
22 tension element
24 gap
26 gap
28 opening
30 bracing element
32 slot
34 holder formation
36 holding means
38 translational movement
40 piston housing
42 engine tube
44 holding unit
46 inner radial bearing
48 bayonet piece
50 outer radial bearing

The invention claimed is:

1. A system of missile control surfaces, comprising:
a control surface housing;
a control surface shaft being rotatably mounted in said control surface housing;
a control surface secured on said control surface shaft;
a control surface drive that is a translational drive, said control surface drive including two piston units engaged with one another and moveable relative to one another; and
a coupling unit coupling said control surface drive to said control surface shaft such that a movement of said control surface drive produces a rotation of said control surface shaft, said coupling unit including two flexible tension elements, each flexible tension element of said two flexible tension elements being secured on a respective one of said two piston units of said control surface drive and rolled up at least partially onto said control surface shaft, wherein the flexible tension element secured to one of said two piston units passes through a slot of the flexible tension element secured to the other one of said two piston units.

2. The system of missile control surfaces according to claim 1, wherein said coupling unit has a bracing element, by means of said bracing element said two piston units can be pushed apart and thus braced relative to one another.

3. The system of missile control surfaces according to claim 1, wherein said control surface drive is a translational drive having a piston unit and a piston housing, and said flexible tension element together with said piston unit extends into said piston housing.

4. The system of missile control surfaces according to claim 1, wherein said control surface drive is a translational drive having a piston unit, and said flexible tension element is secured on said piston unit.

5. The system of missile control surfaces according to claim 4, wherein said flexible tension element is embodied integrally with said piston unit.

6. The system of missile control surfaces according to claim 1, wherein said flexible tension element is secured on an element of said control surface drive and is thicker radially in relation to said control surface shaft in a region in which it is secured than in a winding region of said flexible tension element.

7. The system of missile control surfaces according to claim 6, wherein said flexible tension element is secured on said element of said control surface drive, and said winding region of said flexible tension element is separated from said element of said control surface drive by a gap, and, in a region of said gap, said flexible tension element thickens radially in relation to said control surface shaft towards an end of said gap.

8. The system of missile control surfaces according to claim 1, further comprising:

an inner radial bearing; and an outer radial bearing, said control surface shaft is held on said control surface housing by said outer radial bearing and is held on an engine housing by means of said inner radial bearing.

9. The system of missile control surfaces according to claim 8, wherein said inner radial bearing is disposed at an axial level of said flexible tension element.

10. The system of missile control surfaces according to claim 8, further comprising a holding unit, said control surface shaft is mounted on said holding unit on its side facing away from said control surface and is held axially by positive engagement on said holding unit, wherein said control surface shaft and said holding unit form an axial sliding bearing.

11. The system of missile control surfaces according to claim 10, wherein said control surface shaft is held radially on said holding unit by means of said inner radial bearing.

12. A method for assembling a system of missile control surfaces according to claim 1, the method comprising the steps of:

securing the control surface drive on the control surface housing;

inserting the control surface shaft into the control surface housing from an outside;

securing the two flexible tension elements of the coupling unit on the control surface shaft, with one of the two flexible tension elements passing through the slot of the other flexible tension element; and rolling up the two flexible tension elements at least partially on the control surface shaft by rotating the control surface shaft.

13. The method according to claim 12, which further comprises securing the control surface shaft axially by positive engagement on an inner axial bearing by rotation.

* * * * *